US006921269B2

(12) United States Patent
Johnson et al.

(10) Patent No.: US 6,921,269 B2
(45) Date of Patent: Jul. 26, 2005

(54) RELATIVE ROTATION SIGNAL TRANSFER ASSEMBLY

(75) Inventors: Theodis Johnson, Phoenix, AZ (US); Dennis W. Smith, Phoenix, AZ (US)

(73) Assignee: Honeywell International Inc., Morristown, NJ (US)

( * ) Notice: Subject to any disclaimer, the term of this patent is extended or adjusted under 35 U.S.C. 154(b) by 0 days.

(21) Appl. No.: 10/631,449

(22) Filed: Jul. 30, 2003

(65) Prior Publication Data

US 2005/0026462 A1 Feb. 3, 2005

(51) Int. Cl.[7] ..... H01R 39/00
(52) U.S. Cl. ..... 439/13; 439/17; 439/19; 439/21
(58) Field of Search ..... 439/13, 17, 19, 439/22, 23

(56) References Cited

U.S. PATENT DOCUMENTS 4,904,190 A * 2/1990 Plocek et al. ..... 439/15
5,501,604 A 3/1996 Roopnarine et al.
5,575,664 A * 11/1996 Sobhani ..... 439/17
5,851,120 A * 12/1998 Sobhani ..... 439/17
6,132,219 A * 10/2000 Sobhani et al. ..... 439/17
6,299,454 B1 * 10/2001 Henderson et al. ..... 439/19
6,663,395 B2 * 12/2003 Sobhani ..... 439/21
2003/0073325 A1 4/2003 Canizales

FOREIGN PATENT DOCUMENTS

EP 0863587 A1 9/1998
WO WO 02/01682 A1 1/2002

* cited by examiner

*Primary Examiner*—Tho D. Ta

(57) ABSTRACT

A signal transfer assembly that is configured to transfer one or more electrical signals between two or more conductive paths that are rotating relative to one another includes two substrates or more substrates and one or more interface assemblies. The substrates each include one or more conductors on one or more surfaces. Each interface assembly is disposed between two substrates and is configured to allow relative rotation between the two substrates. Each interface assembly also electrically couples selected ones of the conductors on each of the substrates together, thereby allowing electrical signals to pass through the assembly.

15 Claims, 5 Drawing Sheets

RELATIVE ROTATION SIGNAL TRANSFER ASSEMBLY

TECHNICAL FIELD

The present invention generally relates to a signal transfer assembly and, more particularly, to a signal transfer assembly that is configured to transfer one or more electrical signals between two or more conductive paths that are rotating relative to one another.

BACKGROUND

Various systems include one or more rotating electrical machines, components, and/or systems. These machines, components, and systems may generate electrical energy, consume electrical energy, or both. In some instances, the electrical energy supplied from, or to, the rotating machine, component, or system, is transferred across a joint or interface in which relative rotation exists. For example, many control moment gyros include a flywheel gimbal assembly that is rotated by an electrical motor. The control power and main electrical power supplied to the motor from, for example, a controller, is transferred across one or more rotating joints.

Presently, many (CMGs) include a signal transfer assembly to transfer one or more signals to and from the controller, across a rotating interface, from and to the CMG motor. In many cases, the signal transfer assembly includes an array of slip rings and brushes. This type of construction results in a signal transfer assembly that may be relatively long. A relatively long signal transfer assembly can negatively impact system size envelope, most notably when a compact CMG system is desired. The brushes in this type of signal transfer assembly can also generate debris. The generated debris can build-up over time, which can result in, among other things, electrical noise, shorting between adjacent circuits, and equipment damage.

Hence, there is a need for a signal transfer assembly that transfers one or more electrical signals across a rotating interface and that has a length that is reduced relative to present designs. There is additionally a need for a signal transfer assembly that does not result in, or at least lessens the likelihood and/or amount, of debris that is generated in the signal transfer assembly. The present invention addresses one or more of these needs.

BRIEF SUMMARY

The present invention provides a signal transfer assembly that transfers one or more electrical signals across a rotating interface. The signal transfer assembly has a length that is reduced relative to present designs, and lessens the likelihood and/or amount of debris that is generated in the signal transfer assembly.

In one embodiment, and by way of example only, a signal transfer assembly includes a first substrate, a second substrate, and a plurality of conduction assemblies. The first substrate has at least one conductor coupled to a surface thereof. The second substrate has at least one conductor coupled a surface thereof. The plurality of conduction assemblies are disposed between the first and second substrates, electrically couple at least one of the first substrate conductors to at least one of the second substrate conductors, and are configured to allow relative rotation between the first and second substrates.

BRIEF DESCRIPTION OF THE DRAWINGS

The present invention will hereinafter be described in conjunction with the following drawing figures, wherein like numerals denote like elements, and wherein.

DETAILED DESCRIPTION

The following detailed description is merely exemplary in nature and is not intended to limit the invention or the application and uses of the invention. Furthermore, there is no intention to be bound by any expressed or implied theory presented in the preceding technical field, background, brief summary or the following detailed description. In this regard, although the present embodiment is, for convenience of explanation, depicted and described as being implemented in a control moment gyro of a satellite attitude control system, it will be appreciated that it can be implemented in other systems and environments, both terrestrial and extraterrestrial.

Figure 1:
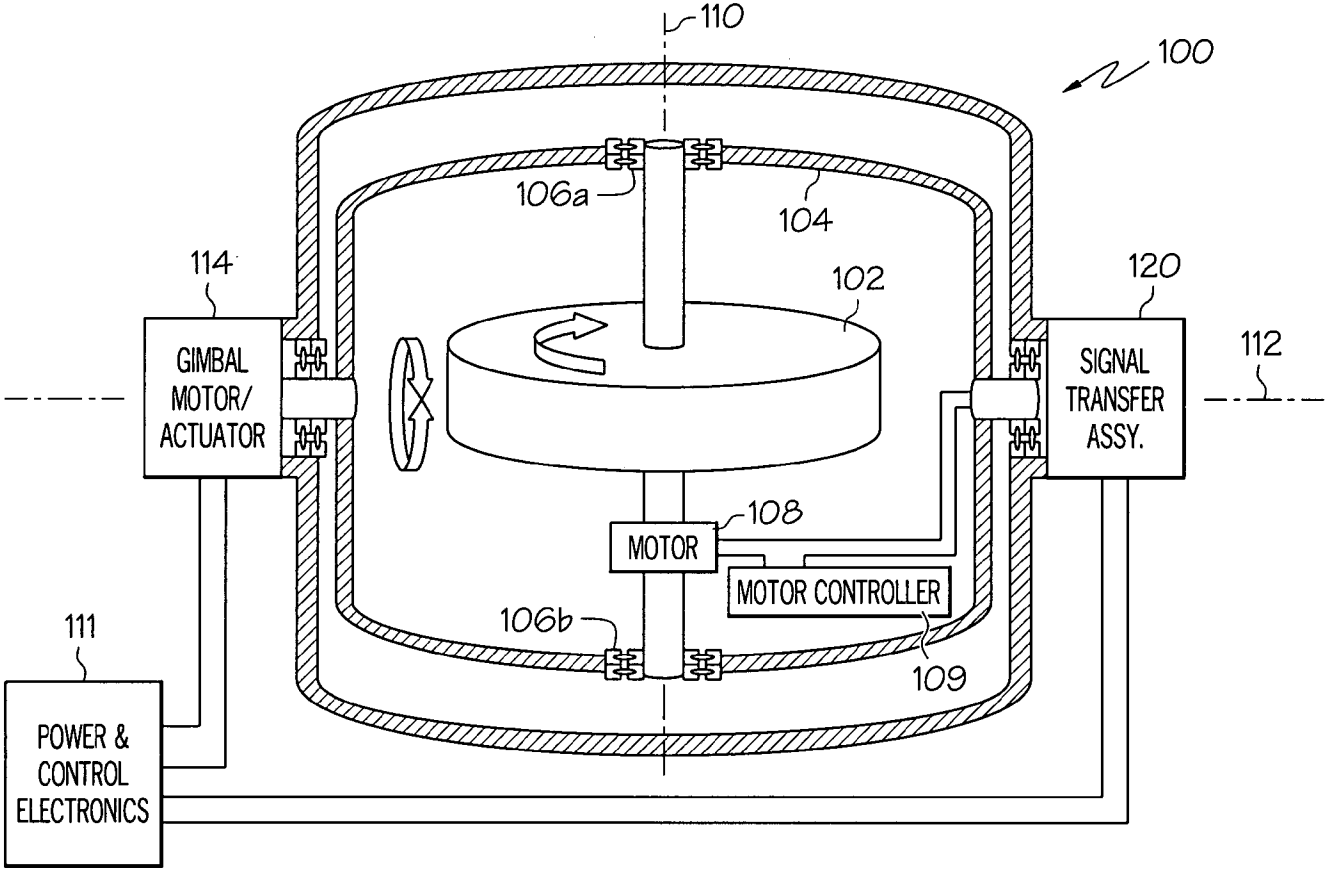
FIG. 1 is a simplified schematic diagram of an exemplary control moment gyro.

Turning now to the description and with reference first to FIG. 1, a simplified schematic diagram of an exemplary control moment gyro (CMG) 100 is shown. The CMG 100 may be installed in a spacecraft such as, for example, a satellite, and may be used in conjunction with other CMGs 100 to control spacecraft attitude. In the depicted embodiment, the CMG 100 includes a flywheel (or rotor) 102 and a gimbal frame 104. The flywheel 102 is rotationally supported on the gimbal frame 104 via a plurality of bearing assemblies 106. In the depicted embodiment, first 106*a* and second 106*b* bearing assemblies are provided, though it will be appreciated that other numbers of bearing assemblies could be provided.

A motive power supply source 108 such as, for example, a motor, is coupled to the flywheel 102 to rotate the flywheel 102 at a desired speed about a spin axis 110. In the depicted embodiment, a motor control circuit 109 supplies control signals to the motor 108. These control signals control the rotational speed of the motor 108 so that it rotates at the desired rotational speed. The motor 108 and motor control circuit 109 also receive electrical power and control signals from a power and control electronics circuitry 111. The electrical power from the power and control electronics circuitry 111 and the control signals from the motor control circuit 109 are transferred to the motor 108 via one or more signal transfer assemblies 120.

The gimbal frame 104 is rotationally supported about one or more gimbal axes 112, which are perpendicular to the flywheel spin axis 110, via one or more gimbal actuators 114. The gimbal actuators 114 are coupled to receive power and control signals from, for example, the power and control electronics circuitry 111. As is generally known, attitude control in a spacecraft may be implemented by changing the angles of each gimbal frame 104 at certain rates (e.g., angular velocities). Thus, in response to attitude commands received from one or more other systems (not shown), the gimbal controller 116 supplies appropriate control signals to the gimbal actuators 114. In response to these control signals, the gimbal actuators 114 move the gimbal frame 104 at the appropriate angular velocities along the gimbal axes 112. One or more sensors (not shown) that can sense, for example, the position and rate of the gimbal frame 104, may be included to supply position and rate feedback signals to the gimbal controller 116.

Figure 2:
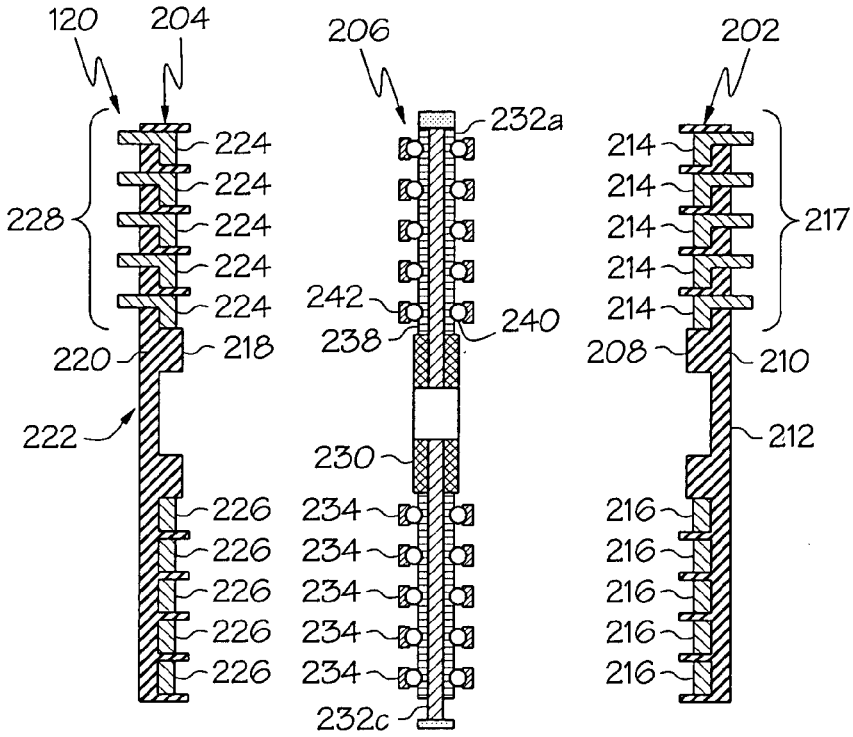
FIG. 2 is an exploded side view of a signal transfer assembly that may be used in the control moment gyro of FIG. 1 according to an exemplary embodiment of the present invention.
Figure 3:
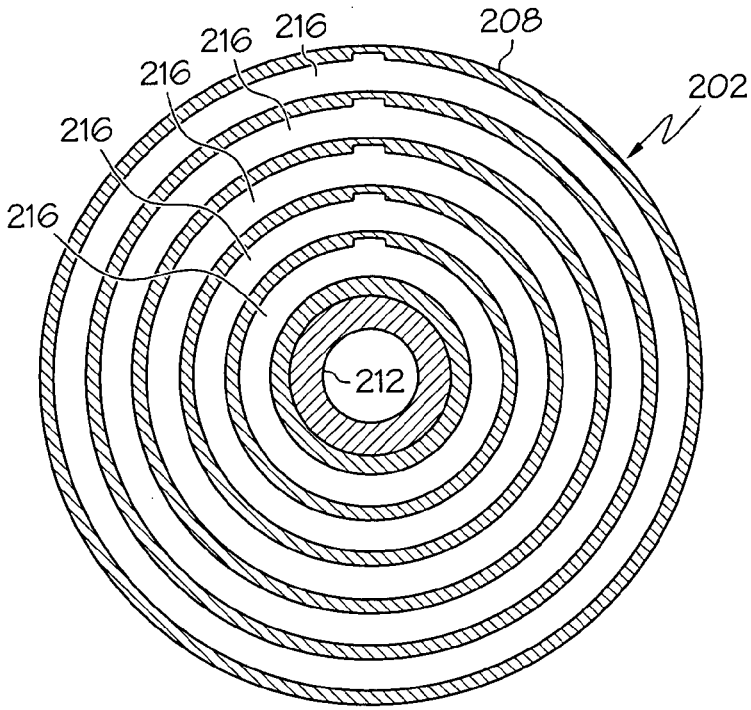
FIGS. 3 and 4 are front views of rotor and stator substrates, respectively, that may be used in the signal transfer assembly of FIG. 2.
Figure 4:
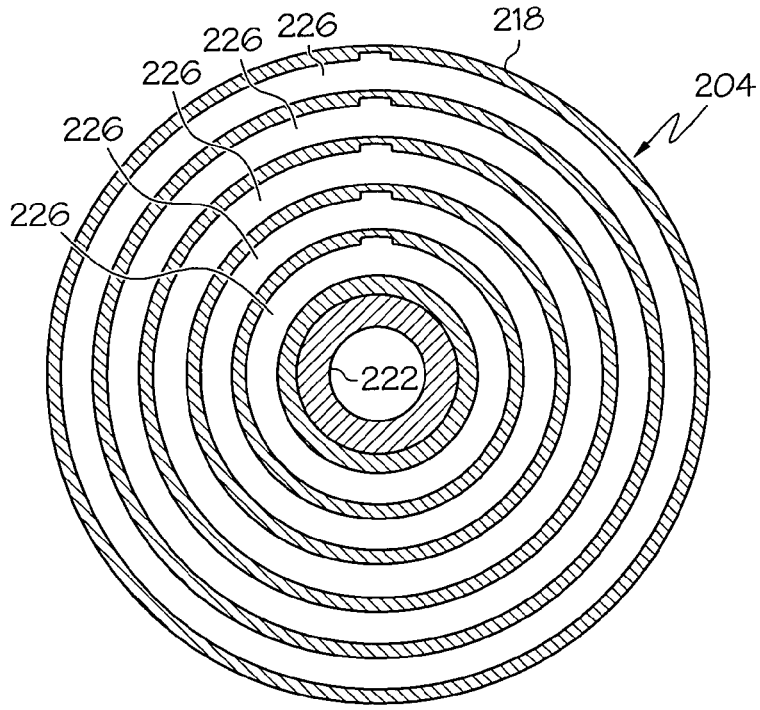

Turning now to FIGS. 2–4, a detailed description of a particular embodiment of the signal transfer assembly 120 will now be provided. The signal transfer assembly 120 includes a rotor substrate 202, a stator substrate 204, and an interface assembly 206. In the depicted embodiment, the rotor substrate 202 is coupled to, and rotates with, the CMG motor 108, while the stator substrate 204 and interface assembly 206 are fixedly mounted to a non-rotating structure such as, for example, the CMG housing (not shown). It will be appreciated that the rotor substrate 202 may be coupled to the CMG motor 108 either directly or via one or more sets of gears. It will additionally be appreciated that in alternative embodiments, the stator substrate 204 could also be coupled to a rotating structure such as, for example, another rotating shaft.

With reference now to FIGS. 2 and 3 in combination, it is seen that the rotor substrate 202 is preferably circular in cross section and includes a first side 208, a second side 210, and a rotor hub 212. A plurality of channels 214 are formed in the rotor substrate first surface 208. A rotor conductor 216, is disposed within each channel 214 and is coupled to the rotor substrate first side 208. The channels 214, and thus the rotor conductors 216, are preferably arranged concentric to, and are radially displaced from, one another. The rotor conductors 216 are selectively electrically coupled to various portions of the CMG motor 108 and/or actuators 114 (or other electrical circuits on the rotating portion of the assembly) via interconnection conductors 217. The interconnection conductors 217 are electrically coupled to each rotor conductor 216, and are preferably routed through the rotor hub 212 to the CMG motor 108, actuators 114, and other circuits such as the motor control circuit 109.

With reference now to FIGS. 2 and 4 in combination, it is seen that the stator substrate 204 is constructed substantially identical to the rotor substrate 202. In particular, the stator substrate 204 is also preferably circular in cross section and includes a first side 218, a second side 220, and a stator hub 222. A plurality of channels 224 are formed in the stator substrate first surface 218, and a stator conductor 226, is disposed within each channel 224 and is coupled to the stator substrate first side 208. As with the rotor substrate 202, the channels 224 in the stator substrate 204, and thus the stator conductors 226, are preferably arranged concentric to, and are radially displaced from, one another. An interconnection conductor 228 is electrically coupled to each of the stator conductors 226. In turn, each stator interconnection conductor 228 is preferably routed through the stator hub 222 and is electrically coupled to the CMG motor controller 109, the gimbal controller 116, motor controller 109, and/or the power and control electronics circuitry 111.

The rotor 216 and stator 226 conductors may be constructed of any one, or plurality, of numerous electrically conductive metals. In a particular preferred embodiment, the conductors 216, 226 are gold plated silver. In addition, although the rotor 202 and stator 204 substrates are each depicted as including six conductors, it will be appreciated that this is merely exemplary, and that each may include more or less than this number of conductors. Moreover, while the rotor 202 and stator 204 substrates are depicted as including only a single conductor 216, 226 in the respective channels 214, 224, it will be appreciated that a plurality of conductors 216, 226 may be disposed within the respective channels 214, 224.

The rotor 216 and stator 226 conductors may be coupled to the rotor substrate first side 208 and stator substrate first side 218, respectively, using any one of numerous methods. Preferably, however, the conductors 216, 226 are coupled to the respective substrate first sides 208, 218 using an etching process. It will additionally be appreciated that each substrate 202, 204 is preferably constructed of a non-conductive material such as, for example, polyamide. Moreover, as is seen most clearly in FIG. 2, each of the rotor substrate channels 214 and rotor substrate conductors 216 is aligned with one of the stator substrate channels 224 and the stator conductors 226, respectively.

Figure 5:
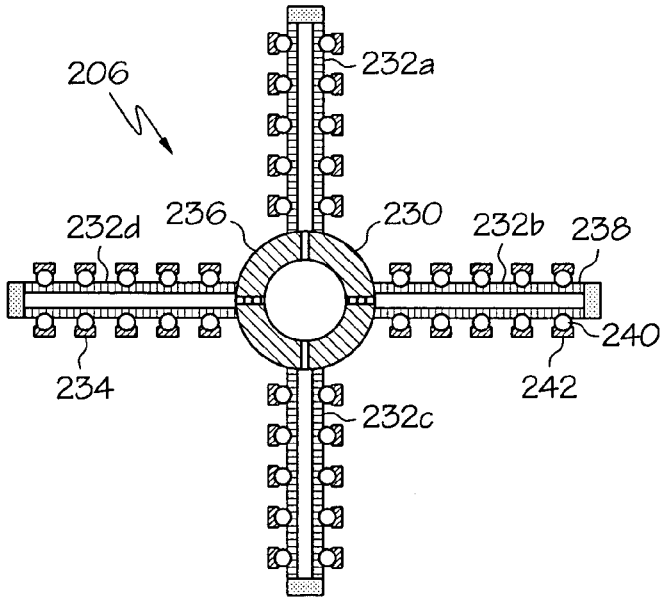
FIG. 5 is a front cross section view of an interface assembly that may be used in the signal transfer assembly of FIG. 2.

The interface assembly 206 is disposed between the rotor 202 and stator 204 substrates, and with reference to FIGS. 2 and 5 in combination, will now be described. In the embodiment depicted therein, the interface assembly 206 includes an inner hub 230, a plurality of bearing retainer arms 232*a–d*, and a plurality of bearing assemblies 234. The retainer arms 232*a–d* are coupled to the inner hub 230, and extend radially away from an outer surface 236 thereof. The retainer arms 232*a–d* may be coupled to the inner hub 230 using any one of numerous methods. For example, the retainer arms 232 could be coupled to the inner hub 230 via an adhesive or one or more individual fasteners. In the depicted embodiment, the retainer arms 232*a–d* each include a set of threads on one end, and are threaded into like-threaded openings in the inner hub 230. It will be appreciated that the retainer arms 232 may be formed of any one of numerous materials, but in a preferred embodiment each is formed of a dielectric material such as, for example, Teflon® or other low friction plastic. Moreover, although four retainer arms 232*a–d* are shown in FIG. 5, it will be appreciated that the interface hub 206 could include more or less than this number.

One or more of the bearing assemblies 234 are mounted on each of the retainer arms 232. Although various numbers of bearing assemblies 234 may be mounted on each of the retainer arms 232, there is preferably at least one bearing assembly 234 per aligned channel 214, 224 mounted on each retainer arm 232. No matter the particular number, each bearing assembly 234 includes an inner race 238, a plurality of bearing balls 240, and an outer race 242. Each bearing assembly inner race 238 is fixedly coupled to one of the retainer arms 232 and, therefore, does not rotate. The bearing balls 240 in each bearing assembly 234 are disposed in rolling contact between the bearing assembly inner race 238 and the bearing assembly outer race 242. The outer race 242 of each bearing assembly 234 is disposed at least partially within one of the aligned rotor and stator substrate channels 214 and 224, respectively. Thus, as shown in FIG. 2, the bearing assembly outer races 242 are each dimensioned to fit within the aligned rotor and stator substrate channels 214, 224, and are in rolling contact with, the rotor and stator conductors 216, 226 disposed within the aligned channels 214, 216. As FIG. 2 also shows, the bearing assembly inner races 238 are preferably substantially wider than the outer races 242. This is because the inner races 238 are used to provide the proper spacing between the bearing assemblies 234, so that the bearing outer races 242 will be substantially aligned with the rotor and stator substrate channels 214, 224. It will be appreciated that the width of the bearing assembly inner races 238 can be varied to provide the appropriate spacing.

The above-described interface assembly 206 configuration allows the rotor 202 and stator 204 substrates to rotate relative to one another. In addition to allowing relative rotation of the substrates, the interface assembly 206 is also constructed and configured such that the aligned rotor 216 and stator 226 conductors are electrically coupled together. As a result, electrical signals may be transferred between the aligned rotor 216 and stator 226 conductors, even when relative rotation exists between the rotor 202 and stator 204 substrates. Although the interface assembly 206 may be constructed in any one of numerous configurations to provide this signal transfer functionality, in a particular preferred embodiment the bearing assemblies 236 are used to electrically couple the aligned rotor 216 and stator 226 conductors. To do so, the bearing assembly outer races 242 are each constructed wholly, or at least partially, of an electrically conductive material, and either or both the inner races 238 and bearing balls 240 are constructed wholly or partially of a dielectric material. In a particular preferred embodiment, the bearing assembly outer races 242 are plated with a highly conductive material such as, for example, gold, the bearing balls 240 are constructed of 440C stainless steel or other electrically conductive material, and the bearing inner races 238 are constructed of beryllium copper, 440C stainless steel, or other materials with suitable corrosion resistance and wear properties. Alternatively, if both the bearing balls 240 and bearing inner races 238 are constructed of an electrically conductive material, an insulating spacer (not shown) could be disposed between each bearing assembly inner race 238.

The signal transfer assembly 120 depicted in FIGS. 2–5 and described above is merely exemplary of one particular embodiment, and other embodiments may be constructed. Two exemplary alternative embodiments are illustrated in FIGS. 6–12, and will now be described. Before doing so, however, it should be understood that like reference numerals in FIGS. 6–11 refer to like parts shown in FIGS. 1–5. Moreover, in both of these alternative embodiments, the rotor 202 and stator 204 substrates are generally identical to those depicted in FIGS. 2–5 and described above, with one substantial difference. Hence, with the exception of the differences, these components will not be further described.

Figure 6:
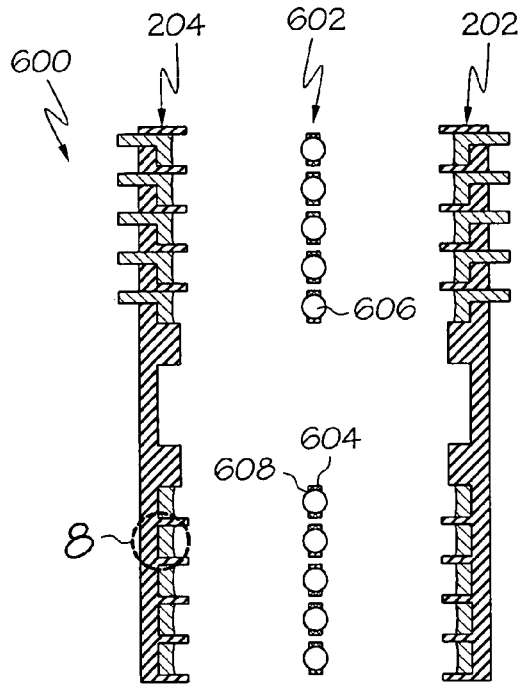
FIG. 6 is an exploded side view of a signal transfer assembly that may be used in the control moment gyro of FIG. 1 according to an exemplary alternate embodiment of the present invention.
Figure 7:
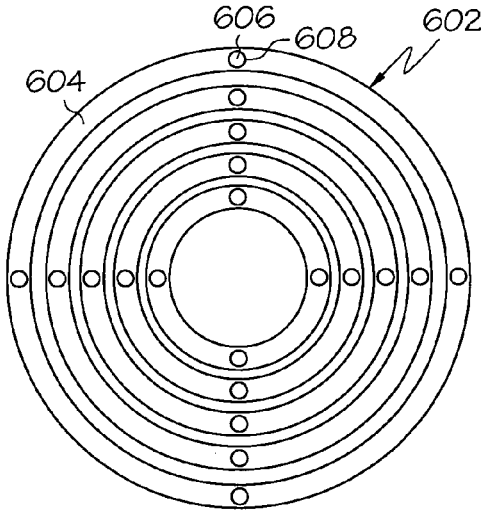
FIG. 7 is a front cross section view of an interface assembly that may be used in the signal transfer assembly of FIG. 6.
Figure 8:
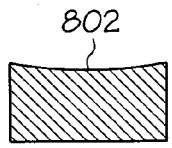
FIG. 8 is a close up view of a conductor used in the signal transfer assembly of FIG. 6.
Figure 9:
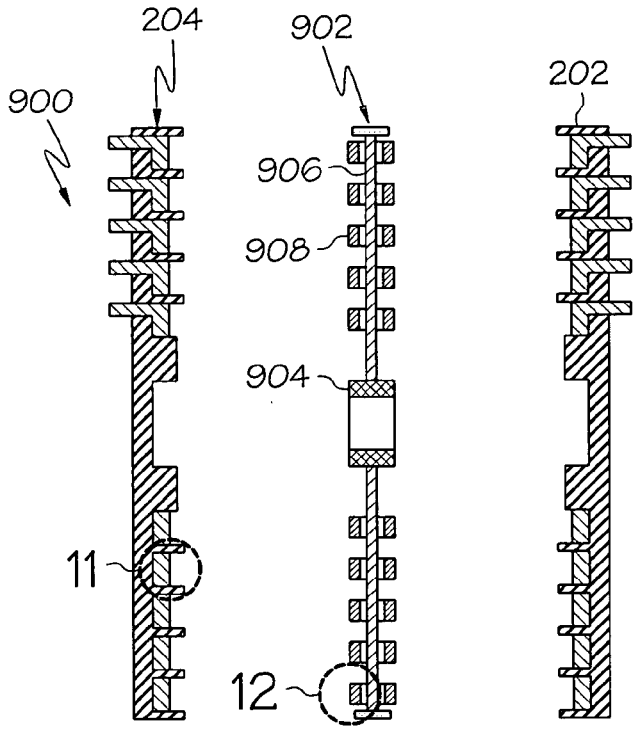
FIG. 9 is an exploded side view of a signal transfer assembly that may be used in the control moment gyro of FIG. 1 according to yet another exemplary alternate embodiment of the present invention.
Figure 10:
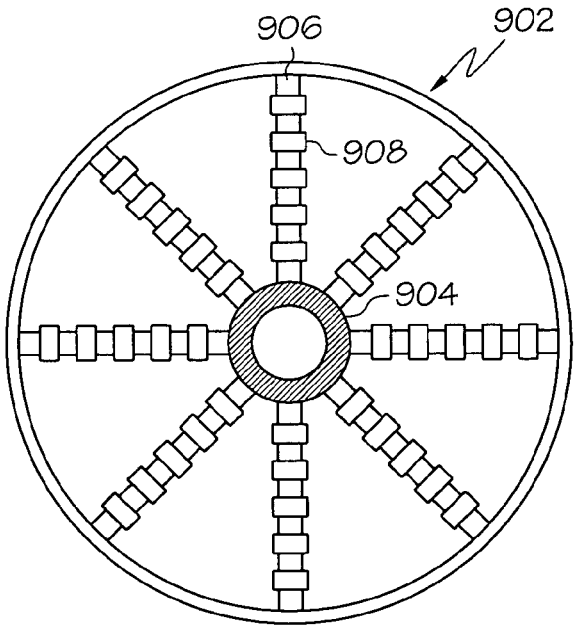
FIG. 10 is a front cross section view of an interface assembly that may be used in the signal transfer assembly of FIG. 9.
Figure 11:
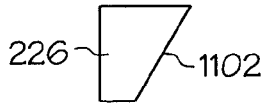
FIGS. 11 and 12 are close up views of a bearing assembly and conductor, respectively, used in the signal transfer assembly of FIG. 6.

Turning first to FIGS. 6 and 7, it is seen that a signal transfer assembly 600 according to a second embodiment includes an interface assembly 602 that is constructed and configured substantially different from the interface assembly 206 of the previous embodiment. In particular, the interface assembly 602 does not include a plurality of bearing assemblies 234 mounted on retainer arms 232. Rather, the interface assembly 602 includes a plurality of bearing retainers 604 and a plurality of bearing balls 606. The bearing retainers 602, as shown in FIG. 7, are each substantially circular in cross section, and are concentrically disposed relative to one another. The bearing retainers 604 each include a plurality of bearing mount apertures 608 that extend through the bearing retainers 604. A substantially spherical bearing ball 606 is disposed within one or more of the bearing mount apertures 608 and is retained therein such that the bearing ball 606 may rotate, but not translate. Hence, when the signal transfer assembly 600 is assembled, the rotor 202 and stator 204 substrates can rotate relative to one another. It will be appreciated that each bearing retainer 604 may have the same or different number of bearing mount apertures 608, and that the same or different number of bearing balls 606 may be disposed within each bearing retainer 604. For example, in the depicted embodiment, each bearing retainer 604 has four bearing mount apertures 608, and a bearing ball 606 mounted in each bearing mount aperture 608. Alternatively, one or more of the bearing retainers 604 could have more or less than four bearing mount apertures 608, each with a bearing ball 606 mounted therein. Moreover, one or more of the bearing retainers could have bearing balls 606 mounted in only some of its bearing mount aperture 608. It will be appreciated that the number of bearing balls 606 disposed within each bearing retainer 604 may be varied to, for example, increase conduction between selected ones of the rotor and stator conductors 214, 224.

In the embodiment depicted in FIGS. 6 and 7, the bearing retainers 604 are each constructed of an electrically non-conductive material, and the bearing balls 606 are constructed wholly, or at least partially, of an electrically conductive material. In a particular preferred embodiment, the bearing retainers 604 are constructed of a low friction, non-conductive plastic such as, for example, Teflon®, and the bearing balls 606 are plated with an electrically conductive metal such as, for example, gold. It will be appreciated that although the bearing retainers 604 are depicted as being implemented as separate structures, each could be part of a single, integral structure.

It was noted above that, with the exception of one substantial difference, the rotor 202 and stator 204 substrates of the embodiment depicted in FIGS. 6 and 7 are generally identical to those of the first embodiment. This one substantial difference is that the surfaces on each of the rotor and stator conductors 214, 224 are contoured. More specifically, and with reference to FIG. 8, which is a close up view of one of the stator substrate conductors 224, it is seen that the outer surface 802 of the conductor 226 is curved. Preferably, the curve on the outer surface 802 has a radius of curvature (R) that substantially matches that of the outer surface on each of the bearing balls 606. This configuration helps ensure that each of the bearing balls 606 remain within its associated channels 216, 226 when relative rotation exists between the rotor 202 and stator 204 substrates.

With reference now to FIGS. 9–12, a signal transfer assembly 900 according to a third embodiment is depicted. In this embodiment, the signal transfer assembly 900 has an interface assembly 902 that is similar to the configuration of the interface assembly 206 of the first embodiment. In particular, similar to the first embodiment 120, the interface assembly 902 includes an inner hub 904, a plurality of retainer arms 906, and a plurality of bearing assemblies 908.

However, as will be described in more detail below, the bearing assemblies are constructed differently than the first embodiment 120.

The retainer arms 906*a–g* of this third embodiment are coupled to the inner hub 230, and extend radially away from an outer surface 910 thereof. The retainer arms 906*a–g* may be coupled to the inner hub 904 using any one of numerous methods. For example, the retainer arms 906 could be coupled to the inner hub 904 via an adhesive or one or more individual fasteners. Alternatively, the retainer arms 906*a–g* could, similar to the first embodiment, each include a set of threads on one end, and be threaded into like-threaded openings in the inner hub 904. It will be appreciated that the retainer arms 906 may be formed of any one of numerous materials. However, similar to the first embodiment 120, each is preferably formed of a dielectric material such as, for example, Teflon® or other low friction plastic. Furthermore, although the depicted interface assembly 902 includes eight retainer arms 906*a–g*, it will be appreciated that the interface assembly 902 could include more or less than this number.

One or more of the bearing assemblies 908 are mounted on each of the retainer arms 906. As was noted above, the bearing assemblies 908 of the present embodiment different from that of the first embodiment 120. In particular, the bearing assemblies 908 are rolling flexure rings that are rotationally mounted on the retainer arms 906. Although various numbers of rolling flexure rings 908 may be mounted on each of the retainer arms 906, there is preferably at least one rolling flexure ring 908 per aligned channel 214, 224 mounted on each retainer arm 906. In the depicted embodiment, the rolling flexure rings 908 are mounted on the retainer arms 906*a–g* such that each is free to translate outward along its respective arm 906. Hence, a radial retainer ring 912 is coupled to ends of each of the retainer arms 906*a–g*.

Figure 12:
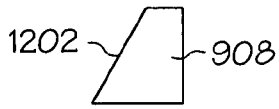

As with the second embodiment 600, the rotor 202 and stator 204 substrates of the third signal transfer assembly embodiment 900 differ from the first embodiment 120 in that the surfaces on each of the rotor and stator conductors 214, 224 are contoured. However, as is shown most clearly in FIG. 11, rather than being curved, the outer surface 1102 of the conductor 226 is tapered. Moreover, as FIG. 12 shows, the outer surface 1202 of each of the rolling flexure rings 908 is tapered to substantially match the taper on the conductor outer surfaces 1102. Similar to the second embodiment 600, this configuration helps ensure that each of the rolling flexure rings 908 remain within its associated channels 216, 226 when relative rotation exists between the rotor 202 and stator 204 substrates.

In each of the signal transfer assembly embodiments described above and depicted in FIGS. 2–12, the conductors 214, 224 were formed on only one surface of each of the substrates 202, 204. However, it will be appreciated that this is merely exemplary of one particular implementation, and that conductors could be disposed on both sides of the either, or both, the rotor 202 and stator 204 substrates. It will additionally be appreciated that each of the signal transfer embodiments could be implemented in a so-called stacked configuration. In a stacked configuration, the signal transfer assembly includes more than one rotor substrate 202 and/or more than one stator substrate 204 and/or more than one interface assembly 206.

The signal transfer assemblies 120, 600, 700 described herein are used to transfer electrical signals between two or more components and/or systems that rotate relative to one another. For example, in the context of the CMG depicted in FIG. 1, the signal transfer assembly 120 is used to transfer motor control signals from the motor control circuit 109 to the rotating motor 108, and electrical power from the main power source 111 to the rotating motor 108. In this implementation, the rotor substrate 202 may rotate, while the stator substrate 204 does not. It will be appreciated that the signal transfer assembly is not limited to such a configuration or end-use environment. Rather, the signal transfer assembly could be implemented in numerous other environments, and could be configured such that both the rotor 202 and stator 204 substrates rotate, in either the same or different directions.

While at least one exemplary embodiment has been presented in the foregoing detailed description, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing the exemplary embodiment or exemplary embodiments. It should be understood that various changes can be made in the function and arrangement of elements without departing from the scope of the invention as set forth in the appended claims and the legal equivalents thereof.

What is claimed is:

1. A signal transfer assembly, comprising:

a first substrate having at least one conductor coupled to a surface thereof;

a second substrate having at least one conductor coupled a surface thereof;

a plurality of conduction assemblies disposed between the first and second substrates, each conduction assembly electrically coupling at least one of the first substrate conductors to at least one of the second substrate conductors, and configured to rotate to thereby allow relative rotation between the first and second substrates, wherein each conduction assembly comprises:

an inner race, an outer race movably coupled to at least one of the conductors on each substrate surface, and a substantially spherical ball disposed between the inner and outer race.

2. The assembly of claim 1, wherein:

the first and second substrates each include one or more channels formed in the respective surfaces thereof, each channel formed in the first substrate surface substantially aligned with a channel formed in the second substrate surface;

each conductor is disposed within one of the channels; and each conduction assembly is disposed within one of the channels formed in the first substrate surface and the substantially aligned channel formed in the second substrate.

3. The assembly of claim 1, wherein each conductor on each substrate is electrically insulated from one another.

4. The assembly of claim 1, wherein each conductor coupled to each substrate is:

substantially circular; and disposed substantially concentric to one or more other conductors.

5. The assembly of claim 4, wherein each of the first and second substrate conductors is coupled to its respective substrate such that each is spaced equidistant from its neighboring conductor.

6. The assembly of claim 1, further comprising:

a hub disposed between the first and second substrates; and a plurality of retainer arms coupled to the hub and extending radially therefrom, wherein each conduction assembly is at least partially mounted on one of the retainer arms.

7. The assembly of claim 6, wherein each retainer arm comprises a dielectric material.

8. A signal transfer assembly, comprising:

a rotor having at least a first surface and a second surface;

a plurality of rotor conductors coupled to the rotor first surface;

a stator having at least a first surface and a second surface;

a plurality of stator conductors coupled to the stator first surface; and a plurality of conduction assemblies disposed between the rotor and stator, each conduction assembly electrically coupling at least one of the rotor conductors to at least one of the stator conductors, and configured to allow relative rotation between the rotor and stator, wherein the plurality of conductions assemblies comprises:

a plurality of spaced apart retainers, each retainer including a plurality of ball openings and concentrically disposed relative to at least one other retainer, and a plurality of substantially spherical balls, each spherical ball rotationally mounted within one of the ball openings and electrically coupled to at least one of the rotor and stator conductors.

9. The assembly of claim 8, wherein:

the rotor and stator each include one or more channels formed in the respective first surfaces thereof, each channel formed in the rotor first surface substantially aligned with a channel formed in the stator first surface;

each conductor is disposed within one of the channels; and each conduction assembly is disposed within one of the channels formed in the rotor first surface and the substantially aligned channel formed in the stator first surface.

10. The assembly of claim 8, wherein each conductor on both the rotor and the stator is electrically insulated from one another.

11. The assembly of claim 8 wherein:

each spherical ball includes an outer surface having a radius of curvature; and each of the rotor conductors and each of the stator conductors includes a curved outer surface having a radius of curvature that substantially matches the radius of curvature of each of the spherical ball outer surfaces.

12. The assembly of claim 8, wherein each rotor and stator conductor is:

substantially circular; and disposed substantially concentric to one or more other conductors.

13. The assembly of claim 12, wherein each of the rotor and stator conductors is coupled to the rotor and stator, respectively, such that each is spaced equidistant from its neighboring conductor.

14. A signal transfer assembly, comprising:

a first substrate having at least one conductor coupled to a surface thereof;

a second substrate having at least one conductor coupled a surface thereof;

a plurality of conduction assemblies disposed between the first and second substrates, each conduction assembly comprising a rotationally mounted radial flexure that electrically couples at least one of the first substrate conductors to at least one of the second substrate conductors, each conduction assembly configured to rotate to thereby allow relative rotation between the first and second substrates.

15. The assembly of claim 14, wherein:

each radial flexure has an outer surface that is tapered in a first direction; and each of the rotor substrate conductors and each of the stator substrate conductors has a tapered outer surface that is tapered in a second direction that is opposite the first direction.

* * * * *